US006795045B2

(12) United States Patent
Jang et al.

(10) Patent No.: US 6,795,045 B2
(45) Date of Patent: Sep. 21, 2004

(54) DRIVING CIRCUIT FOR FLAT PANEL DISPLAY DEVICE

(75) Inventors: Sung Jin Jang, Seoul (KR); Kuk Tae Hong, Seongnam (KR)

(73) Assignee: LG Electronics Inc., Seoul (KR)

( * ) Notice: Subject to any disclaimer, the term of this patent is extended or adjusted under 35 U.S.C. 154(b) by 194 days.

(21) Appl. No.: 10/080,352

(22) Filed: Feb. 21, 2002

(65) Prior Publication Data

US 2002/0190933 A1 Dec. 19, 2002

(30) Foreign Application Priority Data

Jun. 14, 2001 (KR) ..... 2001-33540
Jun. 14, 2001 (KR) ..... 2001-33545

(51) Int. Cl.[7] ..... G09G 3/30

(52) U.S. Cl. ..... 345/77; 345/212; 345/690; 345/691; 315/169.3

(58) Field of Search ..... 345/36, 76–89, 345/204–207, 691, 690, 211, 212; 315/127, 160, 169.3, 169.4, 194

(56) References Cited

U.S. PATENT DOCUMENTS 5,656,892 A * 8/1997 Zimlich et al. ..... 315/169.3
5,719,589 A * 2/1998 Norman et al. ..... 345/82
5,923,309 A * 7/1999 Ishizuka et al. ..... 345/82
6,061,041 A * 5/2000 Yoshida ..... 345/76
6,204,834 B1 * 3/2001 Baker et al. ..... 345/75.2
6,310,589 B1 * 10/2001 Nishigaki et al. ..... 345/76
6,465,966 B2 * 10/2002 Konuma ..... 315/169.1
6,509,885 B1 * 1/2003 Hanaki et al. ..... 345/76
6,545,651 B2 * 4/2003 Nishigaki et al. ..... 345/76
6,646,654 B2 * 11/2003 Takagi ..... 345/690
2002/0000953 A1 * 1/2002 Masanori ..... 345/36

* cited by examiner

*Primary Examiner*—Henry N. Tran
(74) *Attorney, Agent, or Firm*—Lee, Hong, Degerman, Kang & Schmadeka

(57) ABSTRACT

A driving circuit for a flat panel display device can compensate luminosity deviation according to panel characteristics of a flat display device. To achieve these and other advantages, the driving circuit for a flat panel display device includes a current control circuit for supplying electric current to a panel of a flat display device, a luminescence time detecting circuit for detecting luminescence time of the flat display device and a digital signal processing circuit for controlling the current control circuit on the basis of the luminescence time.

12 Claims, 3 Drawing Sheets

DRIVING CIRCUIT FOR FLAT PANEL DISPLAY DEVICE

BACKGROUND OF THE INVENTION

1. Field of the Invention

The present invention relates to a driving circuit for a flat panel display device and particularly, to a driving circuit for a flat panel display device which compensates luminosity deviation according to a panel characteristic an organic electroluminescent display device.

2. Description of the Background Art

FIG. 1 is a view showing a conventional driving circuit for an electroluminescent (EL) display device.

As shown in FIG. 1, the conventional driving circuit for the organic EL display device includes a current control circuit 2 for supplying constant current $I_0$ to an organic EL display device 1 and a switching circuit 3 for switching the constant current $I_0$ supplied from the current control circuit 2 to the organic EL display device 1.

On the other hand, FIG. 2 is a view showing a graph of a constant current $I_{EL}$ supplied to the organic electroluminescent display device and a voltage of both ends $V_{EL}$ of organic electroluminescent display device 1 according to time T. At this time, Ith and Vth designate critical values with which the organic EL display device 1 emits.

Therefore, in the conventional organic EL display device, the switch circuit 3 is turned on for the time of Δd and the constant current $I_{EL}$ is supplied from the current control circuit to the organic EL display device 1. Accordingly, The voltage $V_{EL}$ of both ends of the organic EL display device 1 is increased and when the voltage $V_{EL}$ surpasses the critical value, the organic EL display device 1 becomes to emit light. At this time, the luminosity of the light emitted from the organic EL display device 1 is determined by the size of the electric current supplied to the organic EL display device 1 and the time for supplying the current. Namely, for generating light having a uniform luminosity, the size of the electric current supplied to the organic EL display device 1 and the time for supplying the current must be uniform. However, generally, since the light-emitting characteristic of the organic EL display device 1 is differentiated according to the panel, light having a uniform luminosity cannot be generated even if an electric current is supplied uniformly in a predetermined size of the electric current and time for supplying the current. The operation will be described with reference to FIG. 3.

FIG. 3 is a graph showing luminosity deviation of respective organic EL display devices at the time that luminescence of the respective organic EL display device is ended.

As shown in FIG. 3, luminosity deviation according to the organic EL display devices is generated at the time Te that luminescence is ended. The luminosity deviation is generated by circuits dependent upon the panel and to prevent the deviation, individual driving circuits according to the characteristics of the panels must be used. However, generally, since designation of a circuit is manufacturing an integrated semiconductor chip, the manufacturing is difficult and increase the manufacturing cost. Also, in case of using the individual driving circuit, the circuit must be re-designed when the luminosity deviation is generated.

As described above, with the convention art, it was difficult that the manufacturing of the driving circuit of the organic EL display device for preventing the luminosity deviation of the organic EL display device.

Also, with the conventional art, the manufacturing cost increases in manufacturing the driving circuit of the organic EL display device for preventing the luminosity deviation of the organic EL display device.

Also, with the conventional art, the circuit must be redesigned when the luminosity deviation is generated also in case individual driving circuits are used for the organic EL display device.

SUMMARY OF THE INVENTION

Therefore, the present invention provides a driving circuit for a flat panel display device, which can compensate luminosity deviation according to panel characteristics of a flat display device.

To achieve these and other advantages and in accordance with the purpose of the present invention, as embodied and broadly described herein, there is provided a driving circuit for a flat panel display device including a current control circuit for supplying electric current to a panel of a flat display device, a luminescence time detecting circuit for detecting luminescence time of the flat display device and a digital signal processing circuit for controlling the current control circuit on the basis of the luminescence time.

The foregoing and other, features, aspects and advantages of the present invention will become more apparent from the following detailed description when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of a driving circuit for a flat panel display device and particularly, of a driving circuit for a flat panel display device which compensates luminosity deviation according to a panel characteristic an organic electroluminescent (EL) display device, examples of which are illustrated with reference to FIGS. 4 to 7.

Figure 1:
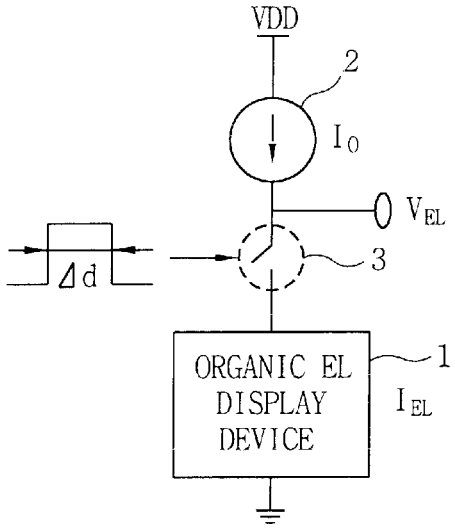
FIG. 1 CONVENTIONAL ART
FIG. 1 is a view showing a conventional driving circuit for an electroluminescent (EL) display device.
Figure 2:
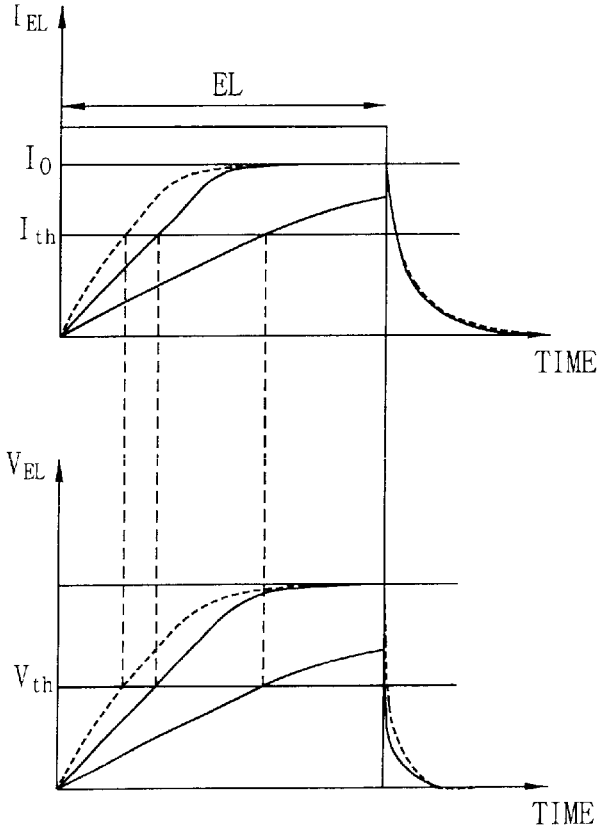
FIG. 2 CONVENTIONAL ART
FIG. 2 is a view showing a graph of a constant current supplied to the organic electroluminescent display device and a voltage of both ends of organic electroluminescent display device according to time.
Figure 3:
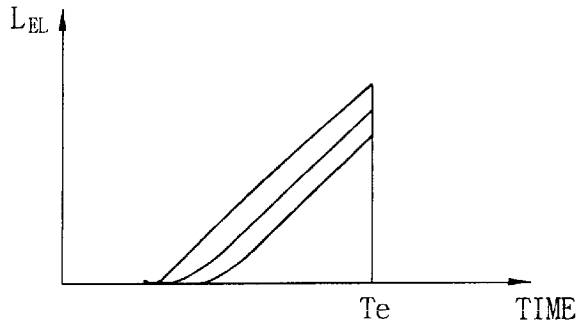
FIG. 3 CONVENTIONAL ART
FIG. 3 is a graph showing luminosity deviation of respective organic electroluminescent display devices at the time that luminescence of the respective organic electroluminescent display device is ended.
Figure 4:
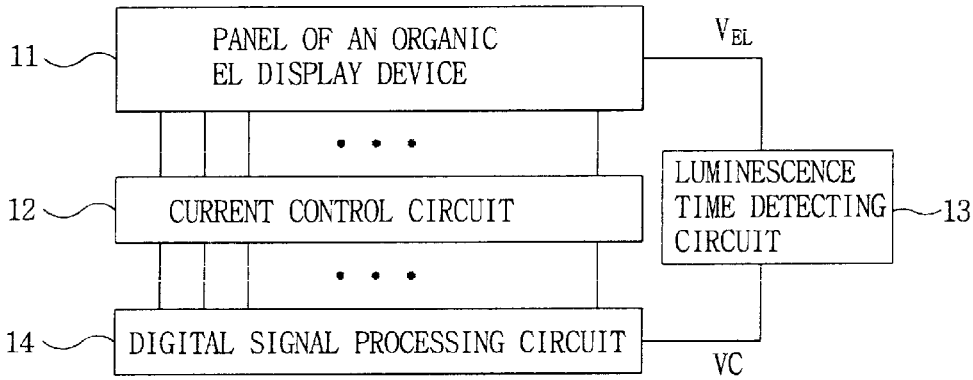
FIG. 4 is a block diagram showing a driving circuit of a flat display device in accordance with the present invention.

FIG. 4 is a block diagram showing a driving circuit of a flat display device in accordance with the present invention.

As shown in FIG. 4, the driving circuit for a flat panel display device in accordance with the present invention, includes a current control circuit 12 for supplying electric current to a panel 11 of an organic EL display device, a luminescence time detecting circuit 13 for detecting luminescence time of the panel 11 of the organic EL display device and a digital signal processing circuit 14 for respectively controlling the luminescence time of the organic EL display devices by controlling the current control circuit 12 on the basis of the luminescence time of the organic EL display devices respectively detected from the luminescence time detecting circuit 13. Here, the luminescence time detecting circuit 13 will be described in detail with reference to FIG. 5.

Figure 5:
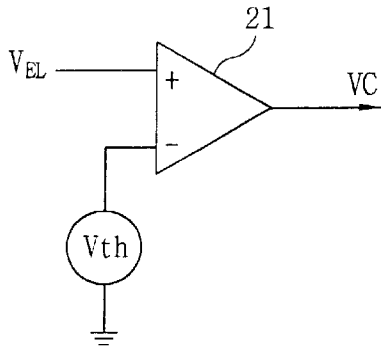
FIG. 5 is an exemplary view showing a luminescence time detecting circuit in accordance with the present invention.

FIG. 5 is an exemplary view showing the luminescence time detecting circuit in accordance with the present invention.

As shown in FIG. 5, the luminescence time detecting circuit 13 includes a comparator 21 for outputting the control voltage VC on the basis of voltage difference comparing the voltage of both ends of the respective organic EL display device $V_{EL}$ and luminescence critical voltage $V_{TH}$ of the organic EL display device from the panel 11 of the organic EL display device and out.

Hereinafter, the operation of the driving circuit of the flat panel display device in accordance with the present invention will be described as follows.

First, when the current control circuit 12 supplies a constant current to the panel 11 of the organic EL display device, the voltage of the both ends $V_{EL}$ of the respective organic EL display device increases and when the voltage $V_{EL}$ surpasses the critical value (critical voltage $V_{TH}$), the respective organic EL display devices emit light.

On the other hand, the comparator 21 outputs the control voltage VC according to the voltage difference receiving the voltage of both ends $V_{EL}$ of the respective organic EL display devices into the positive terminal (+) and the critical voltage Vth into the negative terminal (−). Here, the control voltage VC will be described in detail with reference to FIG. 6.

Figure 6:
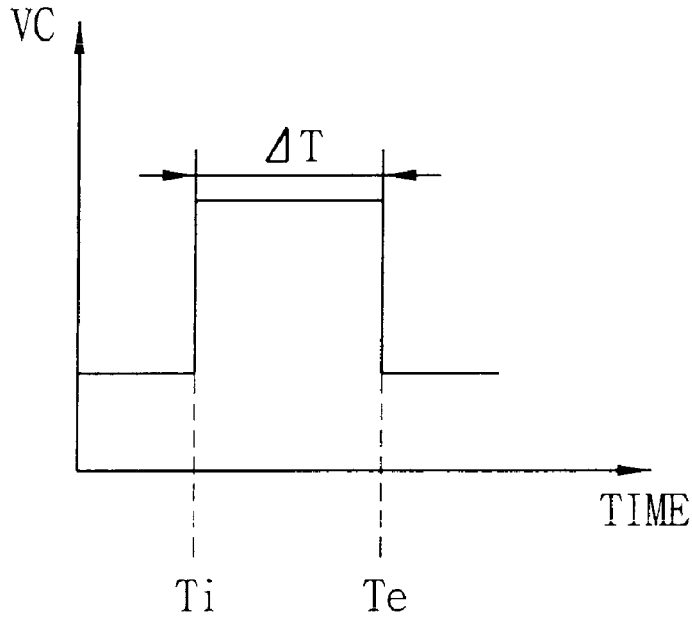
FIG. 6 is a graph showing control voltage of a comparator in accordance with the present invention.

FIG. 6 is a graph showing control voltage of the comparator in accordance with the present invention.

As shown in FIG. 6, the comparator 21 outputs control voltage VC in the pulse type having a rising edge at the time Ti when light-emitting of the respective organic EL display devices begins and a falling edge at the time Te when light-emitting ends. At this time, the pulse area of the control voltage can be information about the luminescence time ΔT of the organic EL display devices.

On the other hand, the digital signal processing circuit 14 receives information about the luminescence time ΔT of the respective organic EL display devices (namely, control voltage (VC)) and outputs the control signal VC for controlling the constant current supplied from the current control circuit 12 to the respective organic EL display devices. Therefore, the digital signal processing circuit 14 outputs the control signal VC to the current control circuit 12 and controls the whole organic EL display devices so that the panel 11 of the organic EL display device can emit light having a uniform luminosity. At this time, the time Ti when light-emitting begins is not detected about the whole organic EL display device of the panel but applies a certain organic EL display device as a central value, thus to minimize the size of the circuit and power consumption. At this time, an example of controlling the light-emitting ending time Te to have a uniform luminosity will be described with reference to FIG. 7 in detail.

Figure 7:
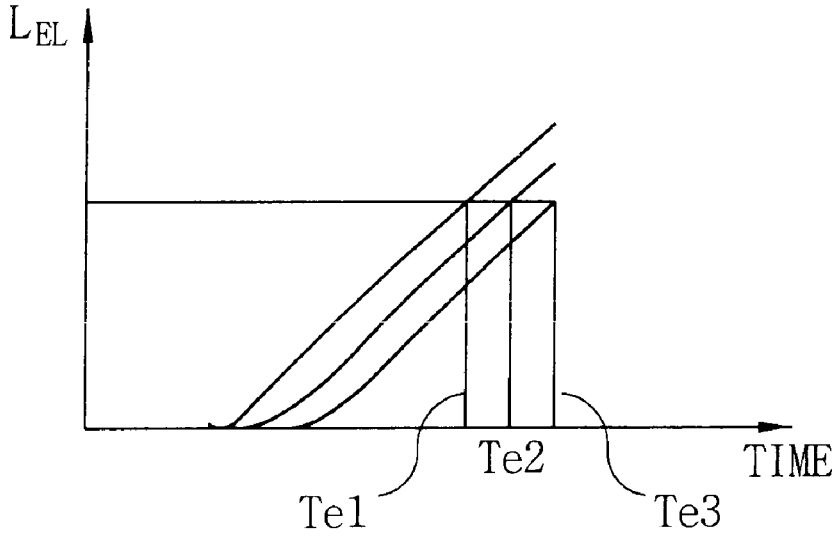
FIG. 7 is an exemplary view showing a state that the time for stopping luminescence is controlled so that the respective organic electroluminescent display device has a certain luminosity.

FIG. 7 is an exemplary view showing a state that the time for stopping luminescence is controlled so that the respective organic EL display device has a uniform luminosity. Namely, FIG. 7 is a graph showing the luminosity curve according to the characteristics of three organic EL display devices. As shown in FIG. 7, the times Te1, Te2 and Te3 when the light-emitting of the respective organic EL display devices is ended is controlled to emit light having uniform luminosity.

As described above, the driving circuit of the flat display device in accordance with the present invention controls the respective organic EL display devices to emit light having uniform luminosity by detecting the luminescence time of the respective organic EL display devices and accordingly the device can drive panels of a plurality of organic EL display devices having respectively different characteristics using a driving circuit of an organic EL display device.

Also, the driving circuit of the flat display device in accordance with the present invention controls the respective organic EL display devices to emit light having uniform luminosity by detecting the luminescence time of the respective organic EL display devices and accordingly, redesigning of the driving circuit is not needed, thus to substantially reduce the cost for developing the driving circuit of the flat display device.

Also, since the driving circuit of the flat display device in accordance with the present invention performs detecting of the luminescence time of the organic EL display device just once thus to minimize power consumption.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A driving circuit for a panel of electroluminescent (EL) display device, comprising:

a current control circuit for supplying an electric current to the panel of the EL display device;

a luminescence time detecting circuit for detecting a luminescence time of the panel of the EL display device based on a voltage difference obtained by comparing a voltage applied to the panel of the EL display device with a luminescence critical voltage of the panel of the EL display device; and a digital signal processing circuit for controlling the electric current on the basis of the detected luminescence time.

2. The circuit of claim 1, wherein the electric current is a constant current.

3. The circuit of claim 1, wherein the digital signal processing circuit outputs a control signal to the current control circuit to control the electric current.

4. The circuit of claim 1, wherein the luminescence time detecting circuit includes a comparator for detecting luminescence time of the panel of the EL display device on the basis of voltage difference comparing the voltage of both ends of the panel of the EL display device and luminescence critical voltage of the panel of the EL display device.

5. The circuit of claim 1, wherein the digital signal processing circuit controls the electric current so that light with a certain luminosity is emitted from the panel of the EL display device on the basis of the luminescence time.

6. The circuit of claim 1, wherein the luminescence time detecting circuit detects luminescence time of the flat panel of the EL display device just one time.

7. The circuit of claim 1, wherein the digital signal processing circuit adjusts luminosity of light of the flat panel of the EL display device uniformly regardless of characteristic of the flat panel of the EL display device using the luminescence time.

8. The circuit of claim 1, wherein the digital signal processing circuit adjusts luminosity of light of the panel of the EL display device uniformly regardless of characteristic of the panel of the organic EL display device using the luminescence time.

9. A driving circuit for a flat panel display device, comprising:

a current control circuit for supplying a constant current into a panel of an organic electroluminescent (EL) display device;

a luminescence time detecting circuit for detecting luminescence time of the panel of the organic EL display device based on voltage difference obtained by comparing a voltage applied to the panel of the organic EL display device and a luminescence critical voltage of the panel of the organic EL display device; and a digital signal processing circuit for controlling luminescence time of the panel of the organic EL display device by outputting a control signal to the current control circuit receiving luminescence time of the panel of the organic EL display device from the luminescence time detecting circuit.

10. The circuit of claim 9, wherein the luminescence time detecting circuit comprises a comparator for detecting luminescence time of the panel of the organic EL display device on the basis of voltage difference comparing the voltage applied to the panel of the organic EL display device and luminescence critical voltage of the flat panel of the organic EL display device.

11. The circuit of claim 9, wherein the digital signal processing circuit controls the constant current so that light having a certain luminosity is emitted from the panel of the organic electroluminescent EL display device on the basis of the luminescence time.

12. The circuit of claim 9, wherein the luminescence time detecting circuit detects luminescence time of the panel of the organic electroluminescent EL display device just one time.

* * * * *